US005135614A

United States Patent [19]

Aula et al.

[11] Patent Number: 5,135,614

[45] Date of Patent: Aug. 4, 1992

[54] SUCTION ROLL FOR A PAPER MAKING MACHINE AND A METHOD FOR PRODUCING A DESIRED PRESSURE PROFILE FOR THE SUCTION ROLL

[75] Inventors: Jouko Aula, Muurame; Heikki Ilvesppää, Jyväskylä ; Allan Liedes, Palokka, all of Finland

[73] Assignee: Valmet Paper Machinery Inc., Finland

[21] Appl. No.: 624,872

[22] Filed: Dec. 5, 1990

[30] Foreign Application Priority Data

Dec. 12, 1989 [FI] Finland ..... 895928

[51] Int. Cl.[5] ..... D21F 3/10; D21F 5/02

[52] U.S. Cl. ..... 162/217; 34/117; 34/120; 162/368; 162/370; 162/372

[58] Field of Search ..... 162/217, 368, 369, 370, 162/371, 372; 34/116, 117, 120

[56] References Cited

U.S. PATENT DOCUMENTS 573,752 12/1896 Allen ..... 162/369
4,876,803 10/1989 Wedel .
4,882,854 11/1989 Wedel et al. ..... 34/115
4,905,379 3/1990 Wedel ..... 34/115
4,974,340 12/1990 Wedel et al. ..... 34/16
4,980,979 1/1991 Wedel ..... 34/23
5,015,336 5/1991 Roerig et al. ..... 162/369
5,024,729 6/1991 Kuhasalo et al. ..... 162/368

*Primary Examiner*—Karen M. Hastings
*Attorney, Agent, or Firm*—Steinberg & Raskin

[57] ABSTRACT

The invention concerns a suction roll (10) for a paper making machine, on which the paper web is pressed towards the outer face of the roll mantle. The suction roll (10) is divided, in the axial direction of the roll, into at least three vacuum spaced ($A_1$, $A_2$, $A_3$). In the interior of the suction roll (10), there are at least two partition walls (17*a*, 17*b*), by means of which the suction space (13) is divided into separate zones of negative pressure. The lateral vacuum spaces ($A_1$, $A_3$) in the suction space can be subjected to a higher negative pressure than the vacuum space ($a_2$) in the middle area of the roll, whereby the profile of negative pressure is formed such that the negative pressure increases across the width of the roll towards the lateral areas. The invention also concerns a method for producing a desired pressure profile for a suction roll.

15 Claims, 7 Drawing Sheets

SUCTION ROLL FOR A PAPER MAKING MACHINE AND A METHOD FOR PRODUCING A DESIRED PRESSURE PROFILE FOR THE SUCTION ROLL

BACKGROUND OF THE INVENTION

The invention concerns a suction roll for a paper machine and a method for producing a desired pressure profile for a suction roll.

One principal objective in paper manufacture is to achieve a paper product which is as uniform as possible. In drying, a paper web shrinks more in its lateral areas than in its middle area. This may even result in the paper in the lateral areas being unusable because of this shrinkage. To maintain the quality of the paper, it is preferable that the shrinkage of paper be small and uniform.

In prior art methods, attempts have been made to avoid this problem by increasing negative pressure in the suction roll. When the negative pressure is increased, the web shrinks less in the middle area, but the difference in shrinkage between the lateral areas and the middle area may become even larger. Thus, the result is not desirable.

SUMMARY OF THE INVENTION

In the present invention, attempts have been made to solve the above mentioned problem and to create an entirely novel roll as a solution of this problem. In the invention a suction roll and method thereof are used such that the profile of negative pressure is made to increase towards the lateral areas across the width of the roll. A preferable shape of the profile is parabolic. In the method of the invention, such a suction roll is used in the drying section wherein both ends of the roll are provided with a structure by whose means a higher negative pressure is produced in these end areas of the roll than in the middle area of the roll. However, it is an essential feature of the roll in accordance with the invention that the roll comprises a profile of negative pressure across its entire width. When the negative pressure is increased in the lateral areas of the roll, the force is increased with which the paper web is pressed against its base, for example a felt. Thereby the friction force in the direction of width of the roll face is increased and, thus, shrinkage of the web in the direction of width is prevented by keeping the web in contact with the felt face.

The suction roll in accordance with the invention comprises the features wherein the suction roll is divided in the direction of the width of the roll into at least three vacuum spaces, while the suction roll comprises at least two partition walls in the interior of the roll, by means of which partition walls the suction space is divided into separate zones of negative pressure, whereby the lateral vacuum spaces in the suction space can be subjected to a higher negative pressure than the vacuum space in the middle area of the roll, whereby the profile of negative pressure is formed such that the negative pressure increases across the width of the roll towards the lateral areas of the roll and whereby, when a roll in accordance with the invention is used, the percentage of shrinkage of the paper web in the lateral areas is reduced and a favorable effect is achieved on the uniformity of said shrinkage.

The method in accordance with the invention comprises the features wherein, with a view to producing the desired profile of negative pressure across the width of the roll and with a view to applying this profile of negative pressure to the paper web to reduce the shrinkage of its lateral area and to equalize the shrinkage of the paper web across the entire width of the web, negative pressure is applied to the paper web across the entire width of the paper web and such that, in the method, partition walls are used, by means of which the suction space in the interior of the roll is divided across the width of the roll into at least three vacuum spaces such that, in the method, the highest negative pressure is applied to the lateral vacuum spaces.

BRIEF DESCRIPTION OF THE DRAWINGS

In the following, the invention will be described with reference to some preferred embodiments of the invention illustrated in the Figures in the accompanying drawings, the invention being, however, not limited to said embodiments alone.

Figure 2A:
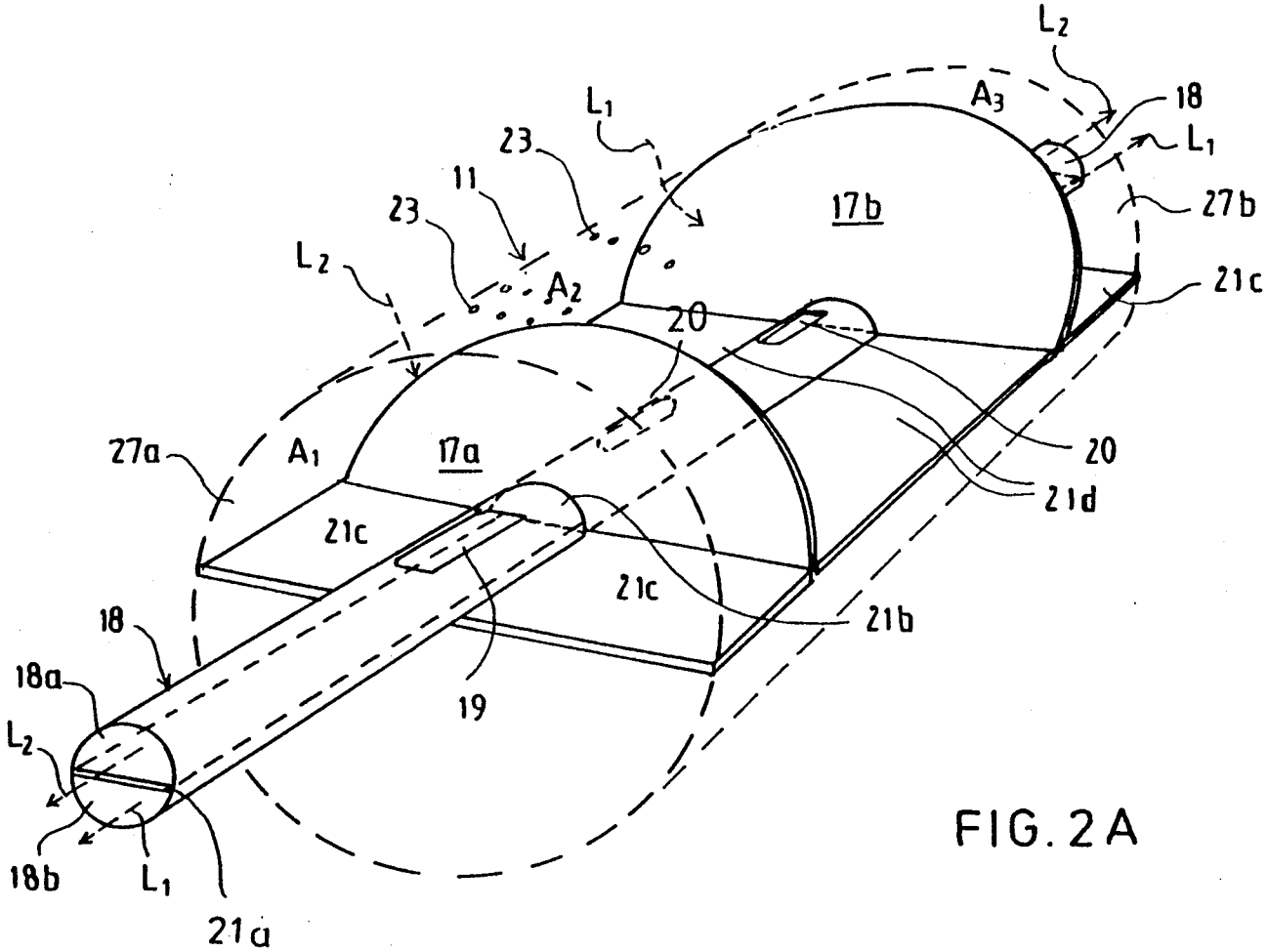
FIG. 2A is an axonometric illustration of a suction roll structure in accordance with the invention, in particular a suction box arrangement.

FIG. **3*b* is a sectional view taken along the line II—II in FIG. 2A**. The wire and the paper web are also shown.

Figure 3B:
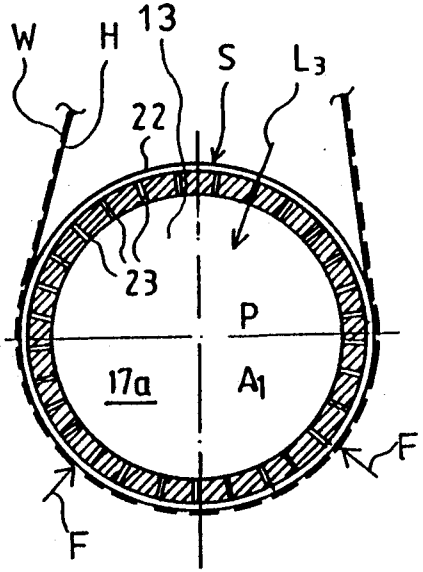
FIG. 3A shows a sectional view of a second preferred embodiment of a suction roll in accordance with the invention.
Figure 3A:
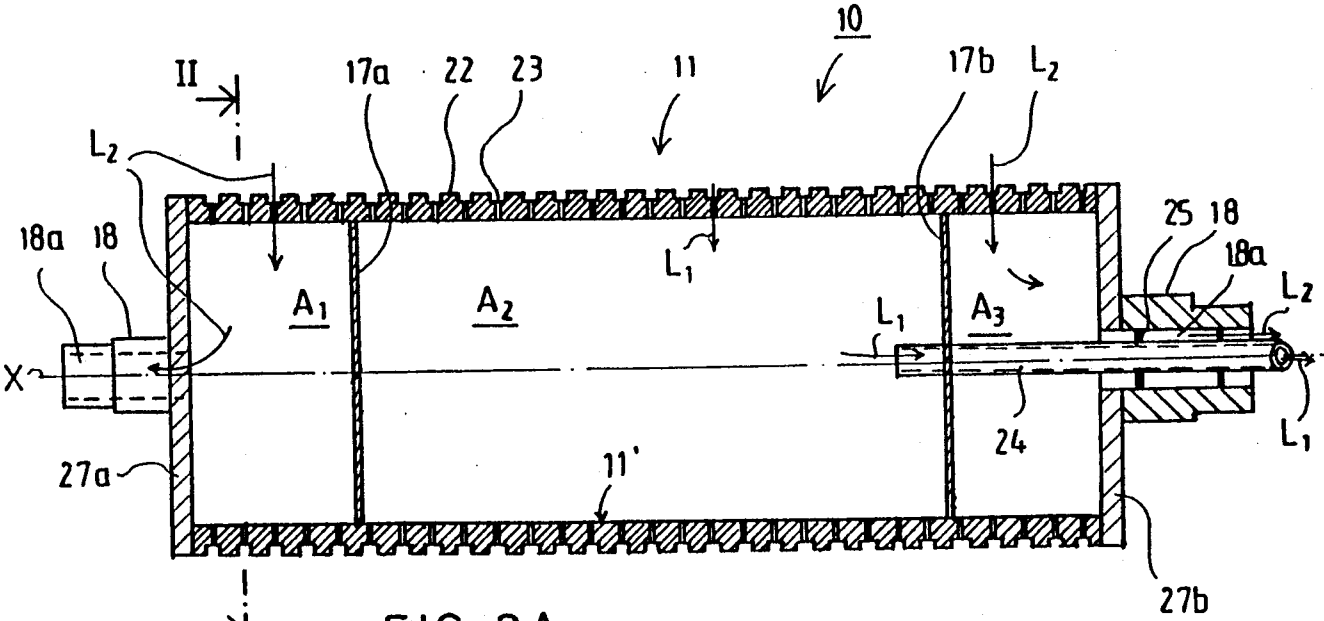
Figure 3C:
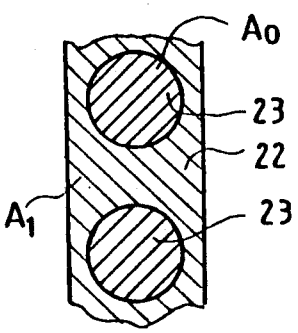

FIG. 3C illustrates the relationship between the cross-sectional flow areas of the grooves and of the perforations in the roll shown in FIG. 3A.

Figure 4A:
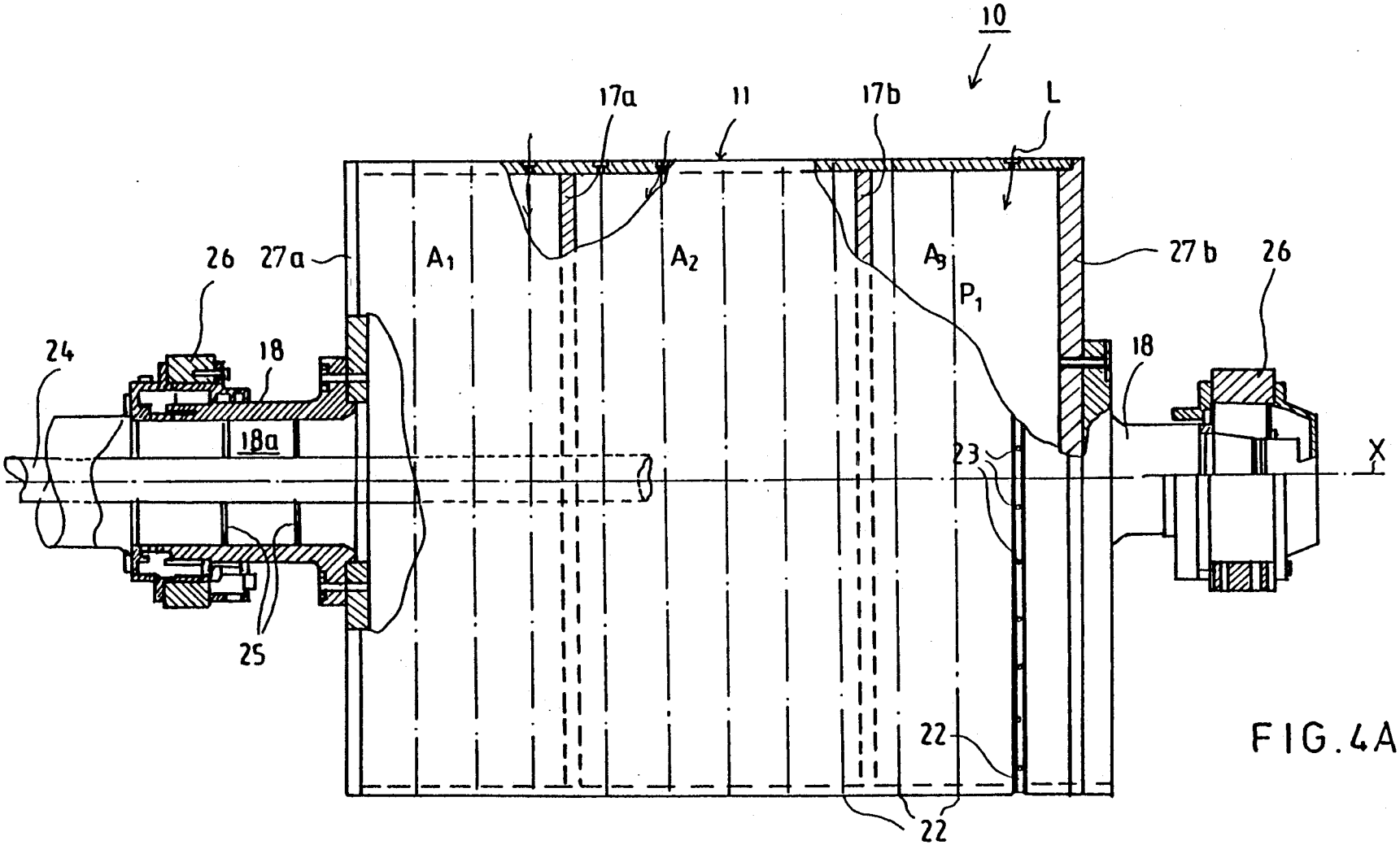

FIG. 4A shows the bearing structure related to the roll shown in FIG. 3. The roll is shown in a sectional view.

Figure 4B:
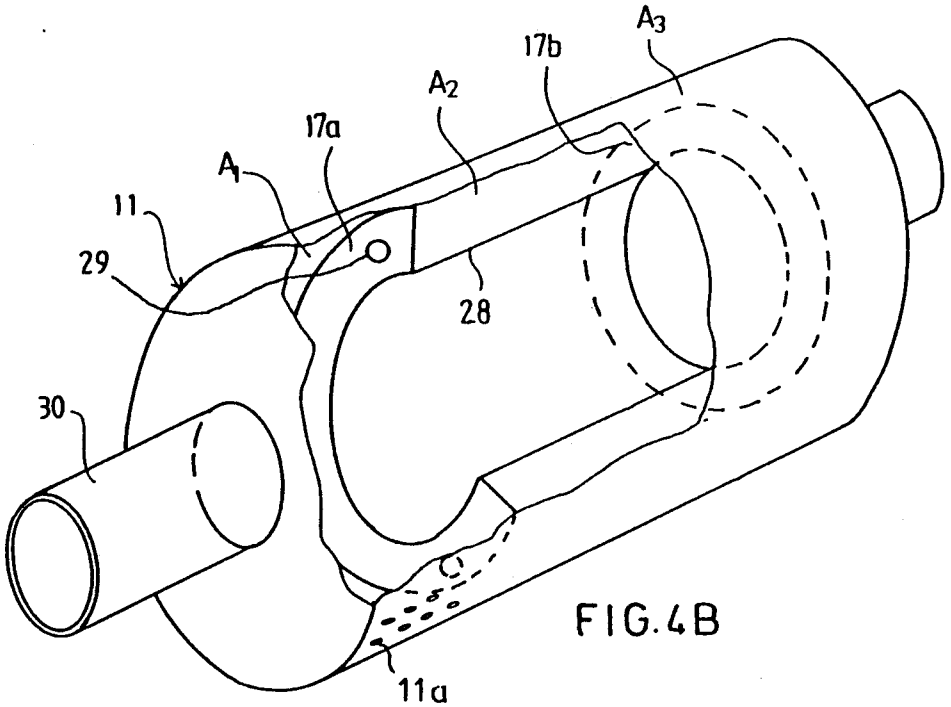

FIG. 4B shows an embodiment of a paper machine suction roll in accordance with the invention wherein the partition wall is defined by a separate bottom part.

Figure 4C:
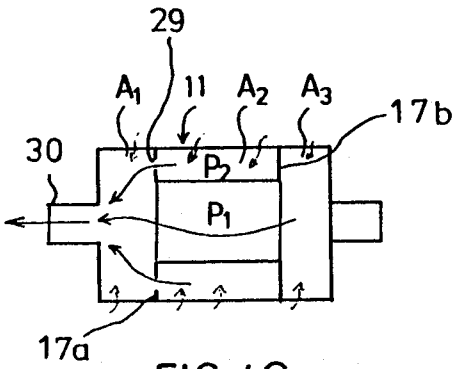

FIG. 4C is a sectional view of the structure shown in FIG. 4B.

Figure 4D:
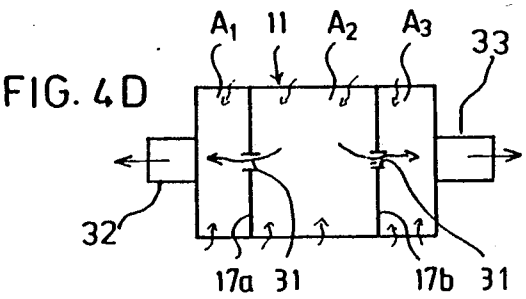

FIG. 4D is a schematic illustration of an embodiment of the invention wherein negative pressure is introduced into the central vacuum space in the roll through perforations in both of the partition walls.

Figure 4E:
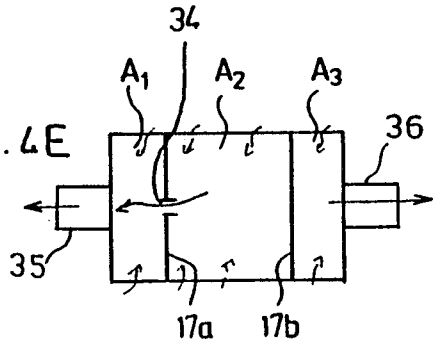

FIG. 4E shows an embodiment of the invention wherein negative pressure is introduced into the central space in the roll through the perforations formed in only one of the partition walls.

Figure 5:
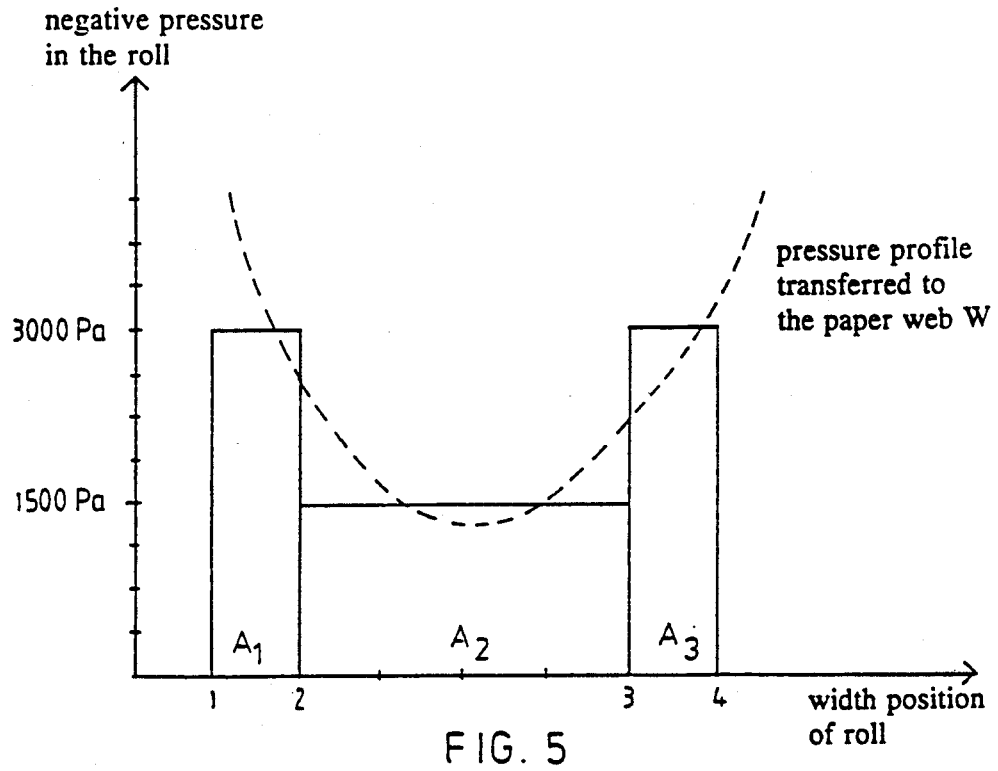

FIG. 5 illustrates a parabolic distribution of negative pressure across the roll width produced by means of the use of partition walls. The vertical system of coordinates represents the negative pressure produced in the interior of the roll, and the horizontal system of coordinates represents the width position of the roll and the locations of the partition walls.

Figure 6:
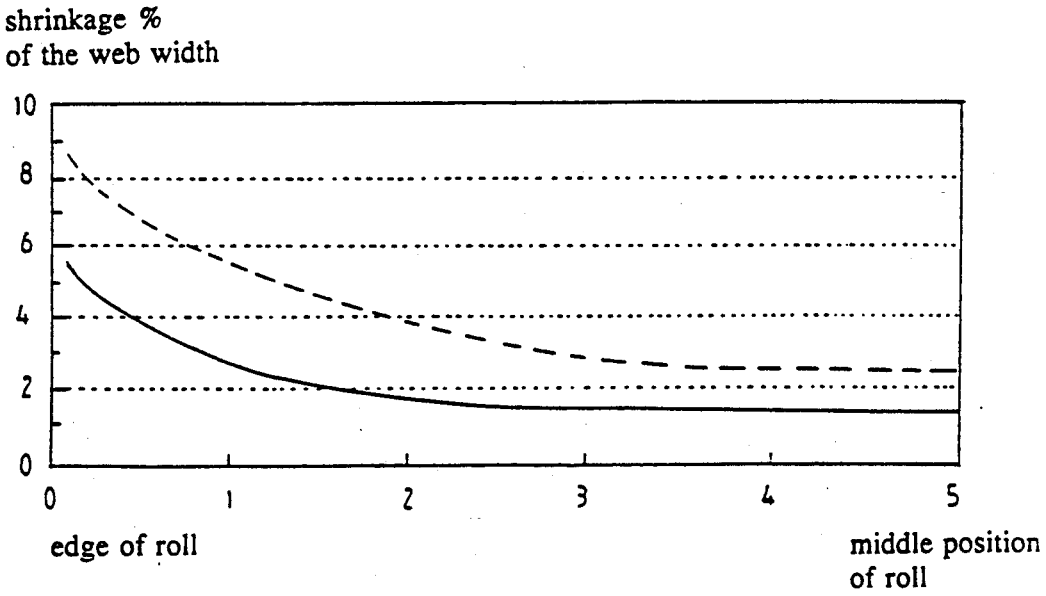

FIG. 6 illustrates a profile of negative pressure across the width of the roll produced by means of a method and a roll structure in accordance with the invention. The vertical system of coordinates represents the percentage of shrinkage of the paper web from the original web width, and the horizontal system of coordinates represents the width position of the roll.

DESCRIPTION OF THE PREFERRED EMBODIMENTS

Figure 1:
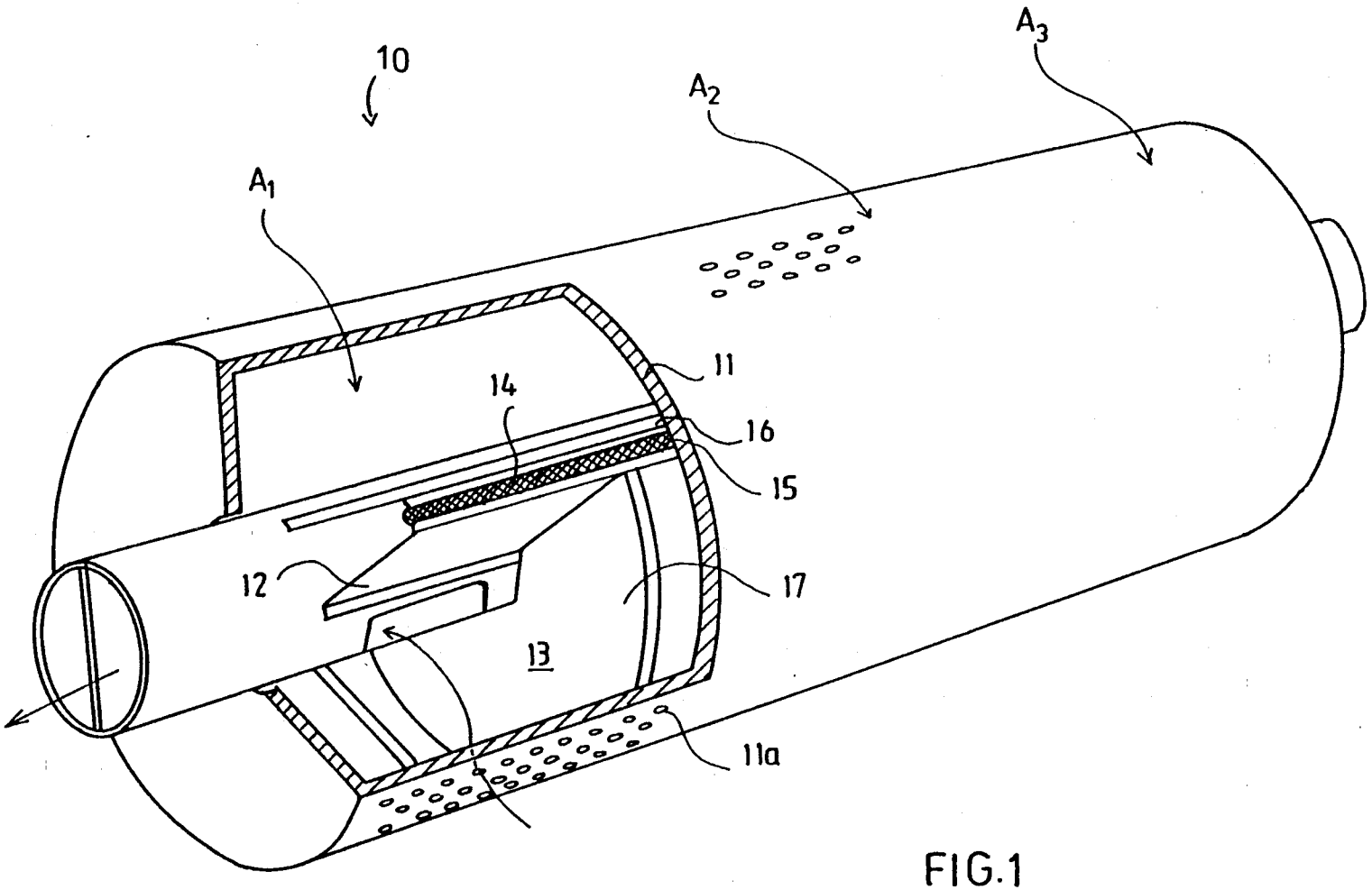
FIG. 1 is an axonometric illustration of a suction roll in accordance with the invention.

FIG. 1 is an axonometric view of a suction roll 10 in accordance with the invention for a drying section. The suction roll 10 comprises a roll mantle 11 and, inside the roll mantle, a suction box 12. In its interior, the suction box 12 defines a suction space 13, and this suction space 13 can be subjected to negative pressure by separate means of negative pressure such as a pump device or the equivalent. An important field of application of a suction roll in accordance with the invention is in the drying section of a paper machine in locations at which the paper web runs outermost on the wire, whereby the paper web is made to adhere to the wire face by means of negative pressure. Thus, by means of this arrangement, the running of the paper web in the drying section is supported. The longitudinal edges 14 of the suction box 12 are provided with sealing means 15, i.e. with edge seals. The sealing means are fitted in sealing seats 16 provided for the sealing means.

According to the invention, the suction space 13 defined by the suction box 12 in its interior is divided into at least three areas or spaces $A_1$, $A_2$ and $A_3$ across the width of the roll, i.e., in the axial direction of the roll. In the embodiment of the invention shown in FIG. 1, the suction box is provided with partition walls 17. In the Figure, one partition wall 17 only is shown. By means of the partition wall 17, the desired negative pressure can be produced at both sides of the partition walls 17. According to the invention, the highest negative pressure is produced in the lateral spaces $A_1$ and $A_3$ defined by the partition walls in the suction roll 10. In the spaces $A_1$ and $A_3$ a negative pressure of substantially equal magnitude is produced, and said negative pressure is higher than the negative pressure in the middle area of the roll in the space $A_2$.

In the embodiment of the invention shown in FIG. 1, the suction roll is provided with bores 11*a* passing through the roll mantle 11. The passage of the air flow is illustrated by means of an arrow.

FIG. 2A is an illustration of a suction roll in accordance with the invention, in particular of the inside structure of the roll. As is shown in FIG. 2A, the suction roll 10 comprises a central axle 18, on which the roll mantle 11 of the suction roll 10 is rotated while the bearings, at the ends of the roll mantle 11 are coupled with the outer face of the axle 18.

A second function of the axle 18 is to act as a pipe by whose means the negative pressure is sucked into the suction space 13 in the suction box 12 inside the roll mantle 11.

As is shown in FIG. 2A, the axle 18 comprises a first duct portion 18*a* and a second duct portion 18*b*. A corresponding arrangement is provided at the other end of the axle. Through the duct portion 18*a*, negative pressure is sucked into the space $A_1$ between the partition wall 17*a* and the end of the roll mantle, the axle 18 being provided with an opening 19 at the proximity of the partition wall 17*a*. Through the other duct 18*b* in the axle 18, negative pressure is sucked into the space $A_2$ placed at the opposite side of the partition wall 17*a*, the duct portion 18*b* in the axle 18 being opened through the opening 20 into the space A2 The duct portions 18*a* and 18*b* are separated by a partition wall 21*a*. At its end, the duct portion 18*b* is defined by the wall 21*b*. Into the spaces $A_1$ and $A_3$, a higher negative pressure is sucked through the duct 18*a* than into the space $A_2$ through the duct 18*b*. Moreover, the negative pressures in the spaces $A_1$ and $A_3$ are substantially equally high. Also, the partition walls 17*a*, 17*b* are connected with a bottom part 21*c* at both sides of the pipe 18. Likewise, in the area between the partition walls 17*a* and 17*b*, at both sides of the axle 18 which operates as a pipe, there is a bottom part 21*d*. In this manner a suction sector subtending an angle of 180° is formed.

Figure 2C:
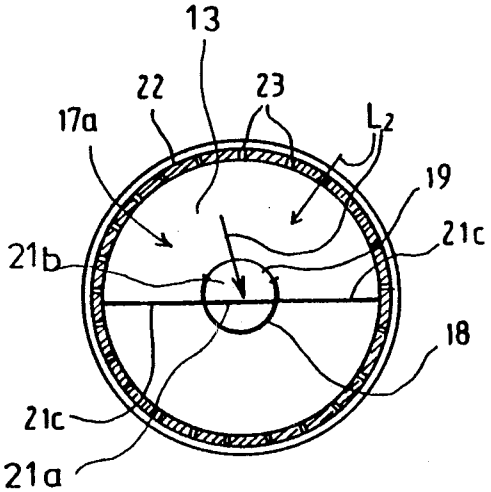
FIG. 2C is a sectional view taken along the line I-I in FIG. 2B.
Figure 2B:
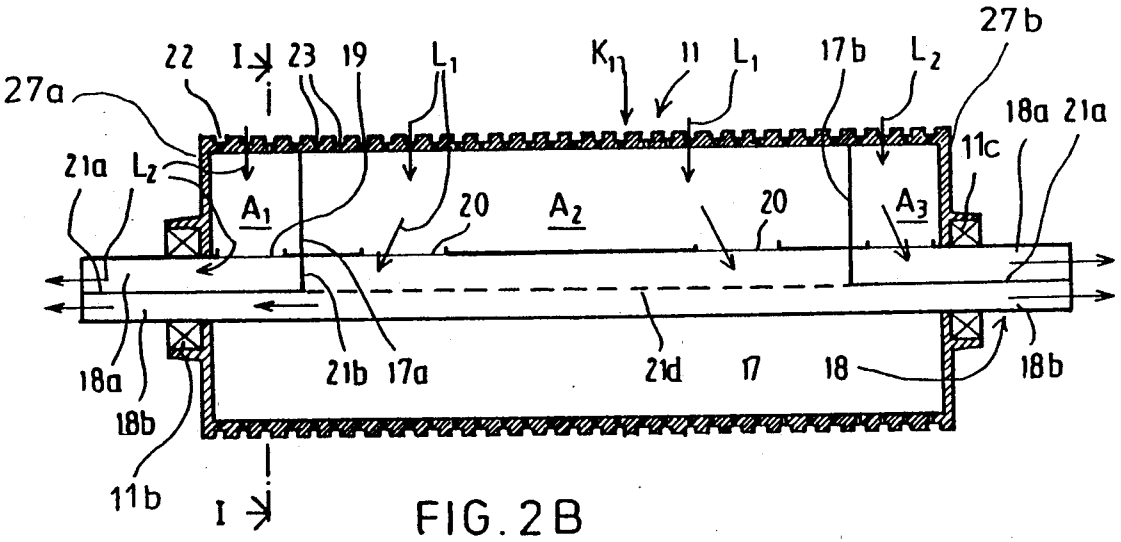
FIG. 2B is a sectional view of the suction roll shown in FIG. 2A.

FIG. 2B is a sectional side view of the roll structure shown in FIG. 2A. As is shown in FIG. 2B, equal negative pressures are produced in the spaces $A_1$ and $A_3$ while the suction flow is directed towards the interior of the roll through holes 23 fitted at the bottom of the circumferential grooves 22 placed in the surface of the roll mantle 11. The partition walls 17*a* and 17*b* are placed substantially equally far from the roll ends. The arrows $L_1$ illustrate the flow through the perforations 23 in the roll mantle 11 into the central space $A_2$ defined by the suction box in its interior and further through the opening 20 into the duct 18*b* in the interior of the axle 18. The partition walls 17*a*, 17*b*, the bottom parts 21*c*, 21*d*, and the axle 18 are fitted to be stationary. The roll mantle 11 revolves on the bearings 11*b*, 11*c*, while the bearings are supported on the axle 18. The arrows $L_2$ illustrate the suction flow through the perforations 23 in the roll mantle 11 into the spaces $A_1$ and $A_3$ and out of these spaces further into the duct 18*a* in the interior of the axle 18.

FIG. 2C is a sectional view taken along the line I-I in FIG. 2B. The groove 22 shown in the Figure comprises a number of holes 23 fitted with the same circumferential spacing. Through the perforations 23, air is made to flow, by means of the negative pressure inside the roll, from outside the roll into its interior and, at the same time, the paper web W running along with the roll is kept in contact with the wire H or an equivalent support, and in this way the running of the paper web is controlled (See FIG. 3B).

Figure 2D:
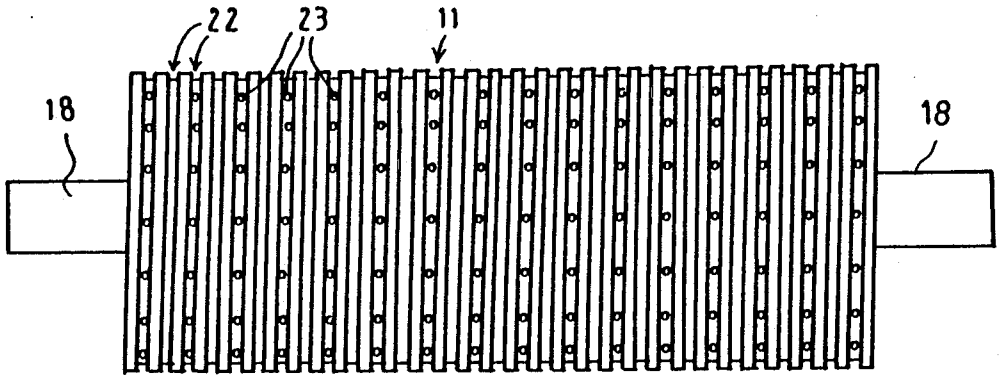
FIG. 2D shows the roll as viewed from above.

FIG. 2D shows the roll of FIG. 2B seen from above in the direction of the arrow $K_1$. The roll comprises circumferentially fitted grooves, but an embodiment is also contemplated in which there is one groove which runs in spiral shape across the entire width of the roll. The perforations are fitted in the bottoms of the grooves.

FIG. 3A shows a second preferred embodiment of the method and suction rolls in accordance with the invention. In the embodiment shown in FIG. 3A, the suction roll is shown in a sectional view. The suction roll 10 comprises perforations 23 in the bottoms of the grooves 22. The roll shown in FIG. 3A does not comprise a suction box inside the roll. Instead, the roll shown in FIG. 3A comprises, in its interior, at least two partition walls 17*a*, 17*b* at equal distances from the end flanges 27*a* and 27*b* of the roll 10. The walls 17*a* and 17*b* are affixed to the inside face 11' of the mantle 11. The axle 18 is a hollow axle, whose duct portion 18*a* is opened into the spaces $A_1$ and $A_3$ between the partition walls 17*a* and 17*b* and the roll ends 27*a* and 27*b*. On the contrary, a lower negative pressure is introduced into the middle area in the roll in the space between the partition walls 17*a* and 17*b*. Into the space $A_3$ a separate pipe duct 24 is opened. Through the pipe 24 or its equivalent, a lower negative pressure is sucked into the middle space $A_2$ than into the lateral spaces $A_1$ and $A_3$, in which substantially equally high negative pressures are provided. The pipe 24 is supported by means of ribs 25 or the equivalent of the duct 18*a* walls.

It is an essential feature of the embodiment of FIG. 3A that the negative pressure is applied at the same time to the interior of the whole roll mantle 11. Thus, the roll does not include a separate suction box inside the roll mantle 11.

FIG. 3B is a sectional view taken along the line II—II of FIG. 3A. The Figure shows the run of the paper web W and the wire H at the leading cylinders in a single wire group, for example a single felt group. The cylinder 10 comprises a number of holes 23, preferably bores, ending in the groove 22. The holes 23 are formed to be equally spaced in the cylinder mantle along its circumference. Into the cylinder 10, into the space $A_2$, negative pressure is produced, e.g., by means of a pump device, and negative pressure is fitted to be present in all operating conditions in this interior space in the drying cylinder 10. The negative pressure is applied, at the same time, to the inner face 11' of the entire mantle 11 of the drying cylinder 10.

In the manner shown in FIG. 3B, a holding force F is applied to the web W, which holding force holds the web to the face of a wire H having good permeability, for example a fabric, and thereby to the outer face of the drying cylinder 10. In this way, detaching of the web from the cylinder 10 is prevented. As is shown in FIG. 2B, the upper face of the cylinder 10 remains free from the wire H and the web W. Through this free face S, an air flow is directed without obstacle into the interior space in the drying cylinder 10. According to the invention, lowering of the negative pressure in the interior space in the roll is prevented by dimensioning the cross-sectional flow areas of the grooves and the holes such that the negative pressure P can be maintained in the interior of the cylinder 10 in spite of this free flow of air L3 through the area S.

According to the invention, the perforation through the roll mantle is carried out such that a controlled air flow into, and a desired negative pressure in, the interior of the cylinder are achieved. A relatively low negative pressure is capable of keeping the web W on the wire face. The effect of this negative pressure is spread in the groove 22, and thereby a force area F of the shape of a band, acting upon the web, is obtained.

FIG. 3C is a schematic illustration of the ratio of the area of the perforations to the area of the grooves provided with perforations. The ratio of the total cross-sectional flow area $A_o$ of the perforations 23 on the suction roll to the total cross-sectional flow area $A_1$ of the perforated grooves 22 is in the range of 1:10 to 1:150, and preferably in the range of 1:50 to 1:110. Advantageously, the flow Q per meter of width of the cylinder into the interior space of negative pressure in the cylinder is in the range of 500 to 1500 $m^3/m/h$, and preferably in the range of 800 to 1200 $m^3/m/h$. The negative pressure in the interior to the suction roll is in the range of 1000 to 3000 Pa.

Thus, when a roll in accordance with FIG. 3A is used, the paper web can be positioned and guided efficiently while the holding force is applied to the paper web in such a way that the web is pressed against the felt along with the roll face in such draws of the web in which the web is placed outermost and on the surface of the felt. The method in accordance with the invention allows for application of the pressure profile across the entire width of the roll and, moreover, in the method in accordance with the invention, the quality of the paper that is formed is influenced favorably by applying a higher negative pressure to both of the lateral areas of the roll as compared with the middle area of the roll.

In FIG. 4A, a structure similar to the preceding embodiment is shown, and in particular the bearing structure is shown. The mantle 11 is supported by its end flanges **27*a* and 27*b* on the bearing means 26 on the bearing block. The axle 18 is a hollow axle, and through said hollow interior space 18*a* pipe means 24 is passed through the partition wall 17*a*. The roll is divided, by the partition walls 17*a* and 17*b*, into three spaces of negative pressure $A_1$, $A_2$, $A_3$. In the spaces $A_1$ and $A_3$ in the lateral parts of the roll, there are substantially equal negative pressures, which are higher than the negative pressure in the middle space $A_2$ in the roll between the partition walls 17*a* and 17*b***.

FIG. 4B is an axonometric illustration in part rf a further embodiment of a suction roll in accordance with the invention which can be used in a drying section. In the embodiment shown in FIG. 4B, the middle space $A_2$ is formed by means of partition walls **17*a* and 17*b*, which partition walls are defined by the inner face of the roll mantle 11 of the suction roll and so also, at the other end, by the cylindrical bottom mantle 28 of circular section. The partition wall 17*a* comprises holes or openings 29. Through the hollow interior space in the axle 30, negative pressure is sucked first into the space $A_1$ and thereupon, through the openings 29, into the space $A_2$. The holes 29 have the throttling effect that the negative pressure in the space $A_2$ is lower than in the space $A_1$. The perforations in the roll mantle 11 are denoted with the reference numeral 11**.

In a corresponding way, suction is produced through the bottom mantle 28 into the space A3 placed at the other side In this space a negative pressure is produced that is substantially equal to the negative pressure in the space Al Thus, only one of the partition walls **17*a* is provided with holes 29**.

FIG. 4C is a sectional view illustrating the operating principle of the structure shown in FIG. 4B. By means of the partition walls **17*a* and 17*b* and the bottom mantle 28, the space in the interior of the roll is divided into pressure areas $P_1$ and $P_2$. The suction flow is passed out through the axle 30 at one end only. The mantle 28 and the partition walls 17*a* and 17*b* are affixed to the inner face of the roll mantle 11** and, thus, revolve along with the roll mantle.

FIG. 4D is a sectional view of a suction roll for a drying section, which comprises walls **17*a* and 17*b* and therein openings or holes 31. Negative pressure is produced through the axles 32 and 33** for the spaces $A_1$, $A_2$ and $A_3$.

FIG. 4*e* shows an embodiment of the invention wherein the suction roll 10 of the drying section comprises partition walls **17*a* and 17*b* and, in the partition wall 17*a*, at least one opening 34. Through the axle 35, negative pressure is sucked first into the space $A_2$ and thereupon into the space $A_3$ in the middle area of the roll, and through the axle 36** the negative pressure is sucked into the space $A_3$ at the other end of the roll.

FIG. 5 is a schematic illustration of a parabolic pressure profile, accomplished by means of partition walls, on the face of a paper web. Between the positions 1 and 2 as well as 3 and 4, there is a higher negative pressure than between the positions 2 and 3 in the space $A_2$. In the lateral spaces between the width points 1 and 2; 3 and 4, there is a negative pressure which is about 3000 Pa, and between the width positions 2 and 3 in the space $A_2$, there is a negative pressure which is about 1500 Pa.

In the Figure, the curve is shown by a dashed line that corresponds to the negative pressure at the face of a paper web. The curve is substantially parabolic. The parabolic shape is affected by the porosity of the wire or the equivalent, and there are no points of discontinuity in the curve of the profile of negative pressure measured on the face of the paper web W.

FIG. 6 illustrates the percentage of shrinkage of the paper web across the width of the paper. In the Figure, a conventional suction roll is illustrated by the dashed line, in which suction roll the same pressure prevails in the interior of the suction roll across the entire width of the suction roll. In the Figure, the full line represents the curve that is obtained when a suction roll in accordance with the invention, which is provided with partition walls, is used. In the vertical system of coordinates, the shrinkage is indicated as a percentage from the original width of the paper web. The horizontal coordinates represent the width position of the roll. It is seen from the Figure that, when a suction roll in accordance with the invention is used, the percentage of shrinkage is, across the entire width of the paper web, lower than in the prior art suction roll structures. Also, when a suction roll in accordance with the invention is used, besides the fact that a lower percentage of shrinkage of the paper web W is obtained at all width positions, the use of this equipment also enables the achievement of a paper quality wherein the proportion of the lateral shrinkage is not substantially greater than the shrinkage of the middle area of the paper web.

Within the scope of the invention, an embodiment is also contemplated in which the interior of the roll is divided by more than two partition walls into several spaces $A_1$, $A_2$, $A_3$, $A_4 \ldots A_n$, in which case in both of the end spaces $A_1$ and $A_n$ in the roll substantially the same negative pressure prevails, and in the spaces $A_2$ and $A_{n-1}$ the same negative pressure prevails, etc., and in which case the negative pressure becomes lower when moving towards the middle area of the roll. It is an advantage of such an embodiment that the shape of the profile of negative pressure can be determined more accurately.

In the method of the invention, the desired pressure profile is obtained for the suction roll and further for the paper web W by dividing the suction roll in its axial direction into spaces of different pressures by means of partition walls, whose wall planes are substantially perpendicular to the axis X of rotation of the roll 10.

The various details of the present invention may vary within the scope of the inventive concepts set forth above, which have been described for the sake of example only. Therefore, the preceding description of the present invention is merely exemplary, and is not intended to limit the scope in any way.

What is claimed is:

1. A suction roll having an axis of rotation for a paper making machine comprising:

a roll mantle having perforations and enclosing a suction space therein, said roll mantel having an outside surface and first and second ends;

at least two partition walls in the interior of said roll for dividing said suction space into separate vacuum spaces across the width of said roll;

a central hollow axle having a duct portion opening into first ones of said vacuum spaces located in proximity to said first and second end of said roll;

separate duct means extending from outside said first and second ends of said roll and through said central axle, said separate duct opening only into a second one of said vacuum spaces located between said first vacuum spaces; and respective separate means for applying negative pressure to said separate vacuum spaces across the width of said roll such that there is an air flow through said perforations into said separate vacuum spaces, said air flow causing a paper web in contact with said roll mantle to be pressed against the outer face of said roll mantle, said vacuum spaces being configured such that negative pressure in said vacuum spaces is applied simultaneously to the entire inner surface of said roll mantle, said respective separate means for applying negative pressure being structured and arranged for applying higher negative pressure to said first vacuum spaces than to said second vacuum space, whereby a profile of negative pressure can be formed such that the negative pressure increases across the width of said roll toward said first and second ends of said roll and whereby the percentage of shrinkage of said paper web is decreased in areas of said roll comprising said separate zones which are closer said first and second ends of said roll.

2. The suction roll of claim 1, wherein said at least two partition walls in the interior of said roll are substantially perpendicular to the axis of rotation of said roll.

3. The suction roll of claim 1, wherein said vacuum spaces are arranged symmetrically with respect to the center of said roll such that substantially identical vacuum spaces are located equidistant from the center of said roll.

4. The suction roll of claim 3, wherein those of said vacuum spaces which are substantially equidistant from the center of said roll are maintained at a substantially equal negative pressure.

5. The suction roll of claim 1, wherein said roll mantle rotates around said axle which is stationary and to which said at least two partition walls are affixed so as to also be stationary.

6. The suction roll of claim 1, wherein said roll mantle comprises grooves on its outside surface running in a circumferential direction around said outside surface of said perforations are situated in said grooves.

7. The suction roll of claim 1, wherein said roll mantle comprises grooves on its outside surface running in a spiral direction around said outside surface, and said perforations are situated in said grooves.

8. The suction roll of claim 1, wherein the roll mantle comprises grooves in its outside surface and perforations extend from said grooves to the inside surface of said roll mantle.

9. The suction roll of claim 8, wherein the ratio of the total cross-sectional flow area of said perforations in said roll mantle to the total cross-sectional area of said grooves is within the range of 1:10 to 1:150.

10. The suction roll of claim 9, wherein said ratio is within the range of 1:50 to 1:110.

11. The suction roll of claim 10, wherein said perforations are of such size that the flow of air through said perforations into the interior of said suction roll is within the range of 500 to 1500 $m^3/m/h$ whereby the flow of air through the portion of the outside surface of said roll mantle not in contact with a roll or felt remains within controlled limits, whereby negative pressure in said separate vacuum spaces is maintained and whereby an adequate holding force to keep said paper web in contact with a felt can be achieved even when said paper web runs outside of said felt relative to said suction roll.

12. A method for the production of a desired pressure profile across the width a suction roll having first and second ends and comprising a roll mantle having perforations therein and enclosing a suction space therein, said method comprising the steps of:

partitioning said suction space into at least three separate vacuum spaces across said width of said suction roll, said vacuum spaces being configured such that negative pressure in said vacuum spaces is applied simultaneously to the entire inner surface of said roll mantle;

providing said suction roll with a central hollow axle having a duct portion opening into first ones of said vacuum spaces located in proximity to said first and second end of said roll;

providing separate duct means extending from outside said first and second ends of said roll and through said central axle, said separate duct means opening only into a second one of said vacuum spaces located between said first vacuum spaces; and generating a higher negative pressure in said first ones of said vacuum spaces of said suction roll than in said second one of said vacuum spaces of said suction roll to thereby substantially equalize the shrinkage of a paper in contact with the surface of said roll mantle throughout the entire surface area of said paper web.

13. The method of claim 12, further comprising partitioning said suction space by using partition walls whose surface planes are substantially perpendicular to the axis of rotation of said suction roll.

14. The method of claim 13, further comprising partitioning said suction space such that said at least three separate vacuum spaces are positioned symmetrically with respect to the center of said roll, and generating substantially equal negative pressure in those of said at least three vacuum spaces which are substantially equidistant with respect to said center of said roll.

15. The method of claim 12, wherein negative pressure is generated by means of a pump.

* * * * *